US011325396B2

(12) United States Patent
Sekino et al.

(10) Patent No.: US 11,325,396 B2
(45) Date of Patent: May 10, 2022

(54) LIQUID EJECTION DEVICE

(71) Applicant: SEIKO EPSON CORPORATION, Tokyo (JP)

(72) Inventors: Hirokazu Sekino, Chino (JP); Takeshi Seto, Shiojiri (JP); Takahiro Matsuzaki, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/161,646

(22) Filed: Jan. 28, 2021

(65) Prior Publication Data

US 2021/0237463 A1 Aug. 5, 2021

(30) Foreign Application Priority Data

Jan. 30, 2020 (JP) ..... JP2020-013694

(51) Int. Cl.
*B41J 2/175* (2006.01)

(52) U.S. Cl.
CPC ..... *B41J 2/17596* (2013.01)

(58) Field of Classification Search
CPC .... B41J 2/14153; B41J 2/175; B41J 2/17596; B41J 2/14233; B41J 2/14145; B41J 2/04531; B41J 2202/08; B41J 2002/14241; B41J 2002/14419; B41J 2002/14306
See application file for complete search history.

(56) References Cited

U.S. PATENT DOCUMENTS

| | | | | |
|---|---|---|---|---|
| 8,371,686 | B2 * | 2/2013 | Yokouchi | B41J 2/17563 347/93 |
| 9,815,284 | B2 * | 11/2017 | Takeuchi | B41J 2/14274 |
| 9,944,087 | B2 * | 4/2018 | Sato | B41J 2/175 |
| 2009/0165828 | A1 | 7/2009 | Sato et al. | |

FOREIGN PATENT DOCUMENTS

| | | | |
|---|---|---|---|
| JP | 2004349501 | A | 12/2004 |
| JP | 2009018250 | A | 1/2009 |
| JP | 2009088079 | A | 4/2009 |

* cited by examiner

*Primary Examiner* — An H Do
(74) *Attorney, Agent, or Firm* — Chip Law Group

(57) ABSTRACT

A liquid ejection device includes: a nozzle configured to eject a liquid; an airflow introduction member configured to introduce an airflow to the liquid; a liquid feeding pump configured to adjust a pressure of the liquid; a pressure pump configured to adjust an introduction pressure of the airflow introduced by the airflow introduction member; and a processor configured to control driving of the liquid feeding pump and the pressure pump, and the processor controls a ratio of the introduction pressure of the airflow to an ejection pressure of the liquid to be 0.005 or more and 0.11 or less.

6 Claims, 7 Drawing Sheets

FIG. 2

| | FLOW RATE OF LIQUID [mL/min] / EJECTION PRESSURE OF LIQUID [MPa] | | |
|---|---|---|---|
| | 20/1.1 | 30/2.4 | 40/4.0 | 50/6.1 |
| INTRODUCTION PRESSURE OF AIRFLOW | | | | |
| 0.00MPa | [illegible] | [illegible] | [illegible] | [illegible] |
| 0.04MPa | [illegible] | [illegible] | [illegible] | [illegible] |
| 0.12MPa | [illegible] | [illegible] | [illegible] | [illegible] |
| 0.15MPa | [illegible] | [illegible] | [illegible] | [illegible] |

LIQUID EJECTION DEVICE

The present application is based on, and claims priority from JP Application Serial Number 2020-013694, filed Jan. 30, 2020, the disclosure of which is hereby incorporated by reference herein in its entirety.

BACKGROUND

1. Technical Field

The present disclosure relates to a liquid ejection device.

2. Related Art

In the related art, various liquid ejection devices that eject a liquid to an object have been used. Among such liquid ejection devices, there is a liquid ejection device aiming at ejecting a liquid to an object with a large amount of energy. For example, JP-A-2009-88079 discloses a substrate processing device that ejects droplets of pure water that are formed by pure water colliding with nitrogen gas.

However, in the substrate processing device of JP-A-2009-88079, a flow rate of the nitrogen gas is larger than a flow rate of the pure water as shown in Table 1 below which is also described in JP-A-2009-88079. In a configuration shown as a comparative example in Table 1, a ratio of the flow rate of the nitrogen gas to the flow rate of the pure water is 0.5 or more. Thus, when the flow rate of the liquid is larger than the flow rate of the gas, or when the ratio of the flow rate of the liquid to the flow rate of the gas is 0.5 or more even when the flow rate of the liquid is smaller than the flow rate of the gas, the liquid droplets are diffused, and it may be difficult to eject the liquid onto the object with a large amount of energy.

TABLE 1

| | Flow rate of gas [L/min] | Flow rate of liquid [L/min] | Average droplet speed [m/s] | Sauter average diameter [μm] | Arithmetic average diameter [μm] |
|---|---|---|---|---|---|
| Embodiment | 150 | 100 | 20.5 | 46.6 | 17.8 |
| | 200 | 100 | 29.8 | 27.3 | 13.8 |
| | 300 | 100 | 47.9 | 17.2 | 10.7 |
| Comparative Example | 50 | 100 | 14.7 | 426.6 | 140.9 |
| | 100 | 100 | 37.0 | 131.1 | 43.2 |
| | 150 | 100 | 57.1 | 96.6 | 20.1 |
| | 200 | 100 | 78.6 | 77.3 | 13.3 |

SUMMARY

A liquid ejection device according to the present disclosure includes: a nozzle configured to eject a liquid; an airflow introduction member configured to introduce an airflow to the liquid; a liquid feeding pump configured to adjust a pressure of the liquid; a pressure pump configured to adjust an introduction pressure of the airflow introduced by the airflow introduction member; and a processor configured to control driving of the liquid feeding pump and the pressure pump, and the processor controls a ratio of the introduction pressure of the airflow to an ejection pressure of the liquid to be 0.005 or more and 0.11 or less.

BRIEF DESCRIPTION OF THE DRAWINGS

FIG. 2 is an image showing a state of droplets when an ejection pressure of a liquid and an introduction pressure of airflow are changed.

DESCRIPTION OF EXEMPLARY EMBODIMENTS

Figure 1:
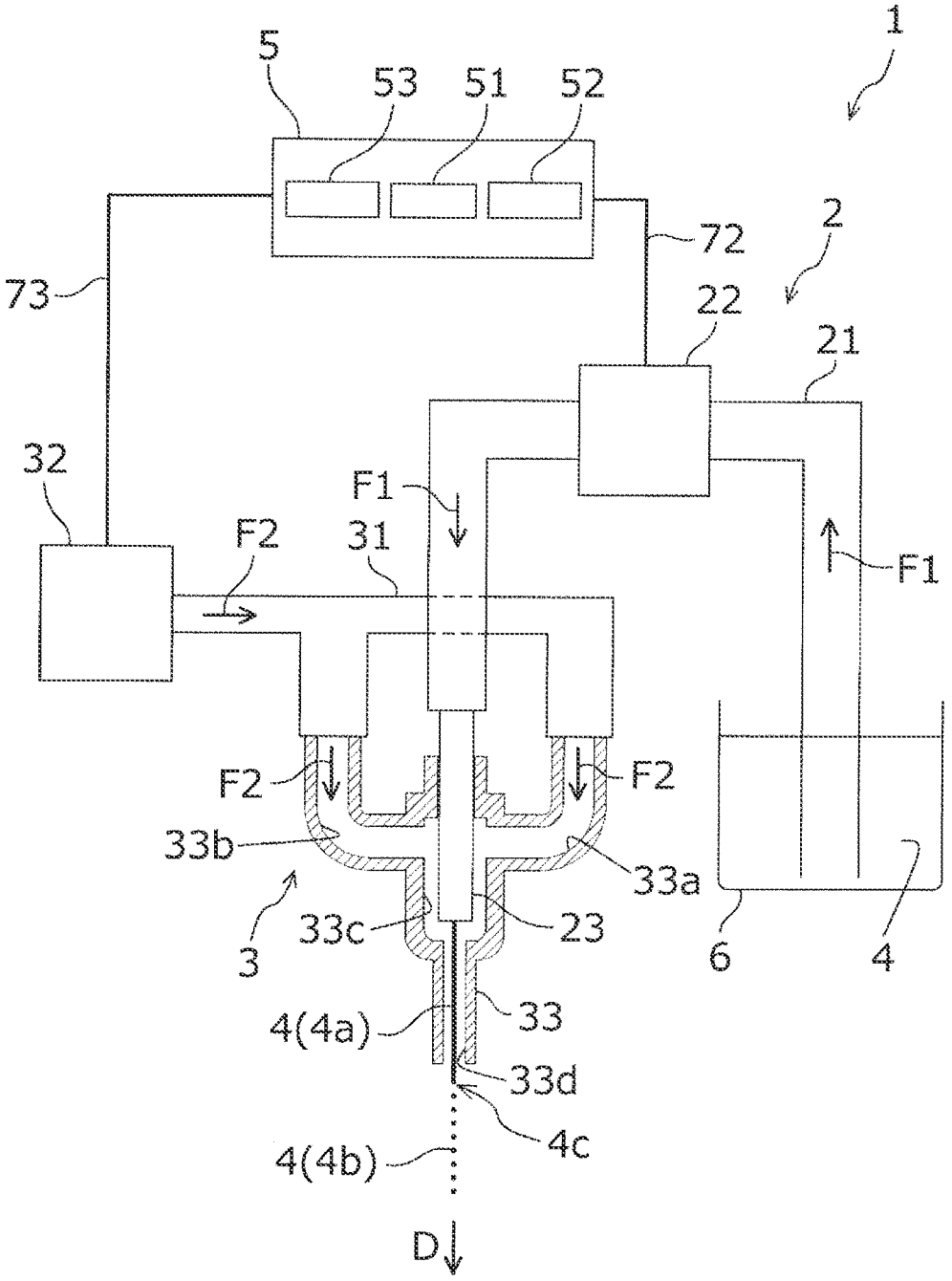
FIG. 1 is a schematic view showing a liquid ejection device according to a first embodiment.

First, the present disclosure will be briefly described.

A liquid ejection device according to a first aspect of the present disclosure includes: a nozzle configured to eject a liquid; an airflow introduction member configured to introduce an airflow to the liquid; a liquid feeding pump configured to adjust a pressure of the liquid; a pressure pump configured to adjust an introduction pressure of the airflow introduced by the airflow introduction member; and a processor configured to control driving of the liquid feeding pump and the pressure pump, and the processor controls a ratio of the introduction pressure of the airflow to an ejection pressure of the liquid to be 0.005 or more and 0.11 or less.

According to the present aspect, the liquid feeding pump and the pressure pump are driven under the condition that the ratio of the introduction pressure of the airflow to the ejection pressure of the liquid is 0.005 or more and 0.11 or less. That is, the liquid can be ejected such that a flow rate of the liquid relative to a flow rate of gas is in a state in which diffusion of droplets is prevented.

The liquid ejection device according a second aspect of the present disclosure is directed to the first aspect, in which the processor drives the pressure pump such that the introduction pressure of the airflow is in a range of 0.01 MPa or more and 0.15 MPa or less.

According to the present aspect, the pressure pump is driven such that the introduction pressure of the airflow is in the range of 0.01 MPa or more and 0.15 MPa or less. When the introduction pressure of the airflow is too low, a droplet formation distance tends to be lengthened, and when the introduction pressure of the airflow is too high, the droplets tend to diffuse, but it is possible to prevent the droplets from diffusing while preventing the droplet formation distance from being lengthened by setting the introduction pressure of the airflow to the above range.

The liquid ejection device according to a third aspect of the present disclosure is directed to the first aspect, in which the processor adjusts the introduction pressure of the airflow in accordance with the ejection pressure of the liquid.

According to the present aspect, the processor adjusts the introduction pressure of the airflow in accordance with the ejection pressure of the liquid. Therefore, it is possible to, in accordance with the ejection pressure of the liquid, effectively prevent the droplets from diffusing while preventing the droplet formation distance from being lengthened.

The liquid ejection device according to a fourth aspect of the present disclosure is directed to the third aspect, in which the processor adjusts the introduction pressure of the airflow based on a Reynolds number of the liquid in the nozzle.

If the Reynolds numbers of the liquid in the nozzle are different, preferable introduction pressures of the airflow for preventing the droplets from diffusing are different. According to the present aspect, it is possible to adjust the introduction pressure of the airflow based on the Reynolds number of the liquid in the nozzle. Therefore, it is possible to, in accordance with the Reynolds number of the liquid in the nozzle, effectively prevent the droplet from diffusing while preventing the droplet formation distance from being lengthened.

The liquid ejection device according to a fifth aspect of the present disclosure is directed to the fourth aspect, in which the processor adjusts the introduction pressure of the airflow such that the introduction pressure of the airflow when the liquid in the nozzle has a Reynolds number of a turbulent flow is lower than that when the liquid in the nozzle has a Reynolds number of a laminar flow.

Depending on whether the liquid in the nozzle is the laminar flow or the turbulent flow, preferable introduction pressures of the airflow for preventing the droplets from diffusing are significantly different. According to the present aspect, it is possible to adjust the introduction pressure of the airflow such that the introduction pressure of the airflow when the liquid in the nozzle has the Reynolds number of a turbulent flow is lower than that when the liquid in the nozzle has the Reynolds number of a laminar flow. Therefore, it is possible to, in accordance with a state of the liquid in the nozzle, particularly effectively prevent the droplets from diffusing while preventing the droplet formation distance from being lengthened.

The liquid ejection device according to a sixth aspect of the present disclosure is directed to the fourth aspect, in which the processor adjusts the introduction pressure of the airflow based on whether the Reynolds number of the liquid in the nozzle is a threshold value or less or exceeds the threshold value when the liquid in the nozzle has the Reynolds number of a laminar flow.

According to the present aspect, when the liquid in the nozzle is a laminar flow, it is possible to adjust the introduction pressure of the airflow such that the ratio of the introduction pressure of the airflow to the ejection pressure of the liquid is small based on whether the Reynolds number of the liquid in the nozzle is a threshold value or less or exceeds the threshold value. Therefore, it is possible to effectively prevent the droplets from diffusing while preventing the droplet formation distance from being lengthened.

Hereinafter, an embodiment of the present disclosure will be described with reference to accompanying drawings.

First, an outline of a liquid ejection device 1 of a first embodiment will be described with reference to FIG. 1. The liquid ejection device 1 shown in FIG. 1 includes an ejecting unit 2 including a nozzle 23 for continuously ejecting a liquid 4; a liquid container 6 for storing the liquid 4; an airflow generation unit 3 including an airflow introduction member 33 for introducing an airflow to a liquid 4*a* ejected in a continuous state from the nozzle 23; and a control unit 5. In FIG. 1, a cross-sectional view of the airflow introduction member 33 is shown to facilitate understanding of an internal configuration.

The liquid ejection device 1 performs various kinds of work by ejecting the liquid 4 from the ejecting unit 2 and the liquid 4 colliding with an object. Examples of the various kinds of work include cleaning, deburring, peeling, trimming, excising, incising, and crushing. Hereinafter, each unit of the liquid ejection device 1 will be described in detail.

Ejecting Unit

The ejecting unit 2 of the liquid ejection device 1 includes a nozzle 23, a liquid transporting pipe 21, and a liquid feeding pump 22. Among these components, the nozzle 23 ejects the liquid 4 toward the object. The liquid transporting pipe 21 is a flow path of the liquid 4 from the liquid container 6 to the nozzle 23. Further, the liquid feeding pump 22 adjusts an ejection pressure of the liquid 4 to be ejected from the nozzle 23 in an ejection direction D.

The ejecting unit 2 will be described in detail below. The nozzle 23 is attached to a tip end portion of the liquid transporting pipe 21. Inside the nozzle 23, a nozzle flow path through which the liquid 4 passes is provided. The liquid 4 transported toward the nozzle 23 in the liquid transporting pipe 21 is formed into a trickle through the nozzle flow path, and is ejected as the liquid 4*a* in a continuous state. The nozzle 23 may be a member separated from the liquid transporting pipe 21 or may be integral with the liquid transporting pipe 21.

The liquid 4*a* in a continuous state ejected from the nozzle 23 is changed into droplets 4*b* by blowing the airflow inside the airflow introduction member 33 to be described later in detail. A distance until the liquid 4*a* in a continuous state ejected from the nozzle 23 is changed into the droplet 4*b*, that is, a droplet formation distance, changes depending on a shape of the airflow introduction member 33, a blowing condition of the airflow, or the like, but the droplet formation distance may be appropriately adjusted. By changing the droplet formation distance, it is possible to change a position of a droplet formation position 4*c*, which is a position where energy to be applied to the object by the liquid 4 ejected from the nozzle 23 is maximized. By shortening the droplet formation distance, work can be performed efficiently even in a narrow work space, so that workability is improved.

The liquid transporting pipe 21 is a pipe an inside of which has a liquid flow path through which the liquid 4 passes in a liquid flow direction F1. The nozzle flow path is in communication with the liquid flow path. The liquid transporting pipe 21 may be a straight pipe, or may be a curved pipe in which a part of or the entire pipe is curved.

The nozzle 23 and the liquid transporting pipe 21 may have rigidity such that the nozzle 23 and the liquid transporting pipe 21 do not deform when the liquid 4 is ejected. Examples of a constituent material of the nozzle 23 include such as a metal material, a ceramic material, and a resin material. Examples of a constituent material of the liquid transporting pipe 21 include such as a metal material and a resin material.

The liquid feeding pump 22 is provided in the middle or an end portion of the liquid transporting pipe 21. The liquid 4 stored in the liquid container 6 is suctioned by the liquid feeding pump 22 and supplied to the nozzle 23 at a predetermined pressure. The control unit 5 is electrically coupled to the liquid feeding pump 22 via a wiring 72. The liquid feeding pump 22 has a function of changing, based on a drive signal output from the control unit 5, a flow rate of the liquid 4 to be supplied. A flow rate in the liquid feeding pump 22 is preferably 1 mL/min or more and 100 mL/min or less, more preferably 2 mL/min or more and 50 mL/min or less, for example. The liquid feeding pump 22 may be provided with a measurement unit that measures an actual flow rate.

The liquid feeding pump 22 may include a built-in check valve as necessary. By providing such a check valve, it is possible to prevent the liquid 4 from flowing back through the liquid transporting pipe 21. The check valve may be provided independently in the middle of the liquid transporting pipe 21.

Liquid Container

The liquid container 6 stores the liquid 4. The liquid 4 stored in the liquid container 6 is supplied to the nozzle 23 via the liquid transporting pipe 21. As the liquid 4, for example, water is preferably used, but an organic solvent may also be used. Any solute may be dissolved in the water or the organic solvent, and any dispersoid may be dispersed in the water or the organic solvent. The liquid container 6 may be a sealed container or an open container.

Airflow Generation Unit

The airflow generation unit 3 includes the airflow introduction member 33, an airflow introduction pipe 31 coupled to the airflow introduction member 33, and a pressure pump 32. Among these components, the airflow introduction member 33 introduces the airflow into the liquid 4*a* ejected in a continuous state from the nozzle 23. The airflow introduction pipe 31 is a gas flow path for supplying gas in an airflow direction F2 toward the airflow introduction member 33. Further, the pressure pump 32 is a pump for introducing the airflow into the airflow introduction member 33 via the airflow introduction pipe 31, and adjusts an introduction pressure of the airflow introduced by the airflow introduction member 33.

The airflow introduction member 33 will be described in detail below. The airflow introduction member 33 is attached to a tip end portion of the airflow introduction pipe 31. Inside the airflow introduction member 33, gas flow paths 33*a* and 33*b* through which gas passes are provided. As shown in FIG. 1, the airflow introduction member 33 includes a gas chamber 33*c*, and the gas in the gas flow paths 33*a* and 33*b* is sent in the airflow direction F2 and introduced into the gas chamber 33*c*.

In the gas chamber 33*c*, the airflow is introduced into the liquid 4*a* ejected in a continuous state from the nozzle 23. The airflow introduction member 33 includes a discharge port 33*d* coupled to the gas chamber 33*c* and extending along the ejection direction D, and the liquid 4 ejected from the nozzle 23 is discharged from the discharge port 33*d*. The gas supplied from the gas flow paths 33*a* and 33*b* to the gas chamber 33*c* is also discharged from the discharge port 33*d* similarly to the liquid 4 ejected from the nozzle 23.

Control Unit

The control unit 5 is electrically coupled to the liquid feeding pump 22 via the wiring 72. The control unit 5 is electrically coupled to the pressure pump 32 via a wiring 73. The control unit 5 includes a liquid feeding pump control unit 52 that controls the liquid feeding pump 22, a pressure pump control unit 53 that controls the pressure pump 32, and a storage unit 51 that stores various data such as control programs for the liquid feeding pump 22 and the pressure pump 32.

The liquid feeding pump control unit 52 outputs a drive signal to the liquid feeding pump 22. Driving of the liquid feeding pump 22 is controlled by the drive signal. Accordingly, for example, the liquid 4 can be supplied to the nozzle 23 at a predetermined pressure and a predetermined drive time. The pressure pump control unit 53 outputs a drive signal to the pressure pump 32. Driving of the pressure pump 32 is controlled by the drive signal. Accordingly, for example, gas can be supplied to the airflow introduction member 33 at a predetermined pressure and a predetermined drive time.

Such a function of the control unit 5 is implemented by hardware such as a processor, a memory, and an external interface. Examples of the arithmetic unit include such as a central processing unit (CPU), a digital signal processor (DSP), and an application specific integrated circuit (ASIC). Examples of the memory include such as a read only memory (ROM), a flash ROM, a random access memory (RAM), and a hard disk.

Specific Control Method Performed by Control Unit

Next, using the liquid ejection device 1 of the present embodiment, how the control unit 5 controls the driving of the liquid feeding pump 22 and the pressure pump 32 will be described with reference to FIGS. 2 to 7.

First, a preferable droplet state of the droplet 4*b* will be described with reference to FIG. 2. FIG. 2 is an image in the case of ejection under the following conditions, and is an image of the droplets 4*b* in which a horizontal direction in the figure corresponding to the ejection direction D. FIG. 2 is an image under the conditions that the introduction pressure of the airflow into the airflow introduction member 33 is set to 0.00 MPa, 0.04 MPa, 0.12 MPa, and 0.15 MPa when a liquid flow rate of the liquid 4 from the nozzle 23 is 20 mL/min and the ejection pressure of the liquid 4 from the nozzle 23 is 1.1 MPa. FIG. 2 is an image under the conditions that the introduction pressure of the airflow into the airflow introduction member 33 is set to 0.00 MPa, 0.04 MPa, 0.12 MPa, and 0.15 MPa when the liquid flow rate of the liquid 4 from the nozzle 23 is 30 mL/min and the ejection pressure of the liquid 4 from the nozzle 23 is 2.4 MPa. FIG. 2 is an image under the conditions that the introduction pressure of the airflow into the airflow introduction member 33 is set to 0.00 MPa, 0.04 MPa, 0.12 MPa, and 0.15 MPa when the liquid flow rate of the liquid 4 from the nozzle 23 is 40 mL/min and the ejection pressure of the liquid 4 from the nozzle 23 is 4.0 MPa. FIG. 2 is an image under the conditions that the introduction pressure of the airflow into the airflow introduction member 33 is set to 0.00 MPa, 0.04 MPa, 0.12 MPa, and 0.15 MPa when the liquid flow rate of the liquid 4 from the nozzle 23 is 50 mL/min and the ejection pressure of the liquid 4 from the nozzle 23 is 6.1 MPa.

As described above, the liquid ejection device 1 of the present embodiment includes the airflow introduction member 33 configured to introduce the airflow into the liquid 4 ejected from the nozzle 23. In the liquid ejection device 1 of the present embodiment, the driving of the pressure pump 32 is stopped, and as shown in FIG. 2, the introduction pressure of the airflow to the airflow introduction member 33 can be set to 0.00 MPa. However, when the introduction pressure of the airflow into the airflow introduction member 33 is set to 0.00 MPa, it is difficult to shorten the droplet formation distance, and a distance from the nozzle 23 to the droplet formation position 4*c* increases. When the distance from the nozzle 23 to the droplet formation position 4*c* increases, the workability is reduced, for example, because the work space needs to be widened.

As shown in FIG. 2, in any case where the ejection pressure of the liquid 4 is 1.1 MPa, the ejection pressure of the liquid 4 is 2.4 MPa, the ejection pressure of the liquid 4 is 4.0 MPa, and the ejection pressure of the liquid 4 is 6.1 MPa, when the introduction pressure of the airflow is 0.00 MPa, 0.04 MPa, and 0.12 MPa, the droplets 4*b* are ejected in an aligned state without being substantially diffused, which is a preferable droplet state. On the other hand, in any case where the ejection pressure of the liquid 4 is 1.1 MPa, the ejection pressure of the liquid 4 is 2.4 MPa, the ejection pressure of the liquid 4 is 4.0 MPa, and the ejection pressure of the liquid 4 is 6.1 MPa, when the introduction pressure of the airflow is 0.15 MPa, the droplet 4*b* is ejected in a state where the droplets start to diffuse to some extent, and starts to deviate from the preferable droplet state.

In addition, as shown in FIG. 2, when the introduction pressure of the airflow is the same, the larger the ejection pressure of the liquid 4, the more easily the droplets 4*b* are aligned without being diffused. In FIG. 2, it can be seen that when the ejection pressure of the liquid 4 is 1.1 MPa and the introduction pressure of the airflow is 0.12 MPa, that is, under a condition that a ratio of the introduction pressure of the airflow to the ejection pressure of the liquid 4 is 0.11 or less, the droplets 4*b* are ejected in an aligned state without being substantially diffused, which is a preferable droplet state. Therefore, as long as the condition is that the ratio of the introduction pressure of the airflow to the ejection pressure of the liquid 4 is 0.11 or less, the droplets 4*b* are ejected in an aligned state without substantial diffusion, which is a preferable droplet state.

Figure 4:
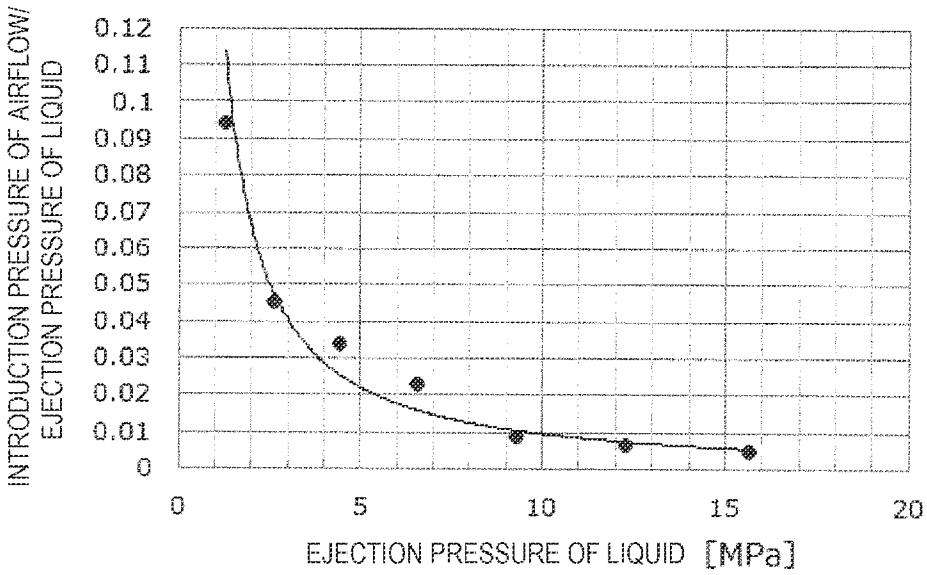
FIG. 4 is a graph showing a relationship between the ejection pressure of the liquid and a ratio of the introduction pressure of the airflow to the ejection pressure of the liquid when the droplet formation distance can be minimized under the condition that droplets in a preferable state can be formed.

Here, a preferable lower limit value of the ratio of the introduction pressure of the airflow to the ejection pressure of the liquid 4 will be described with reference to FIG. 4. As shown in FIG. 4, in a plot where the ejection pressure of the liquid 4 is less than 16 MPa, the ratio of the introduction pressure of the airflow to the ejection pressure is more than 0.005. In the image of FIG. 2 where the ejection pressure of the liquid 4 is 6.1 MPa and the introduction pressure of the airflow is 0.04 MPa, that is, "the introduction pressure of the airflow/the ejection pressure of the liquid"=0.04/6.1=0.0065, a diffusion jet starts to occur. Therefore, a preferable lower limit value of the ratio of the introduction pressure of the airflow to the ejection pressure of the liquid 4 is 0.005.

According to the above description, in the liquid ejection device 1 of the present embodiment, the control unit 5 drives the liquid feeding pump 22 and the pressure pump 32 under the condition that the ratio of the introduction pressure of the airflow to the ejection pressure of the liquid 4 is 0.005 or more and 0.11 or less and the introduction pressure of the airflow is not set to zero in order to shorten the droplet formation distance. Therefore, in the liquid ejection device 1 of the present embodiment, the liquid 4 can be ejected such that the flow rate of the liquid 4 relative to the flow rate of the gas is in a state in which the diffusion of the droplets 4*b* is prevented. The condition in which the introduction pressure of the airflow is not set to zero in order to shorten the droplet formation distance is a condition in which the liquid 4 ejected in a continuous state from the nozzle 23 has a droplet formation distance shorter than that when no airflow is introduced.

Figure 3:
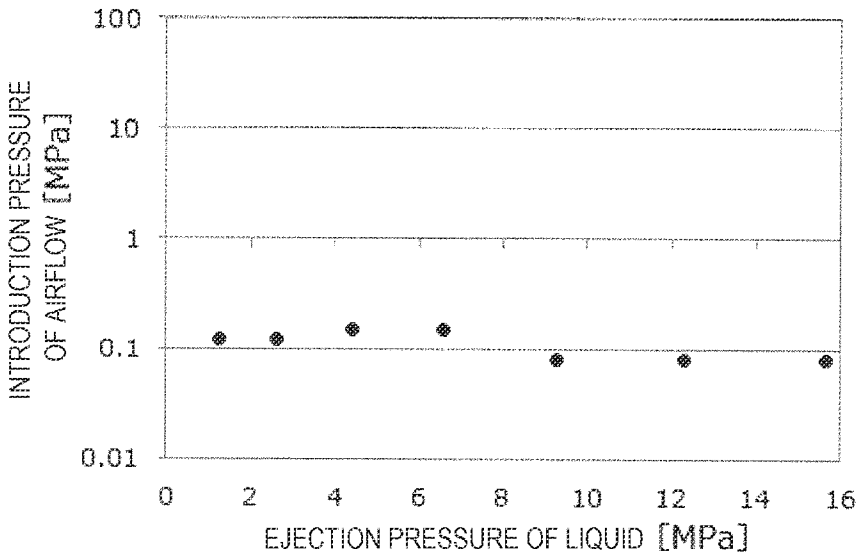
FIG. 3 is a graph showing a relationship between the ejection pressure of the liquid and the introduction pressure of the airflow when a droplet formation distance can be minimized under a condition that droplets in a preferable state can be formed.

Next, a more preferable specific control method performed by the control unit 5 will be described with reference to FIG. 3 in addition to FIG. 2. In FIG. 3, a relationship between the ejection pressure of the liquid 4 and the introduction pressure of the airflow is shown by a circular dot when the droplet formation distance can be minimized under the condition that the droplets 4*b* in a preferable state can be formed. As shown in FIG. 3, when the ejection pressure of the liquid 4 is changed from about 1 MPa to about 16 MPa, the introduction pressure of the airflow is substantially around 0.1 MPa. In other words, the preferable introduction pressure of the airflow when the ejection pressure of the liquid 4 is changed is in a range of 0.01 MPa or more and 1.00 MPa or less, and more preferably in a range of 0.08 MPa or more and less than 0.15 MPa.

According to the above description, the control unit 5 can drive the pressure pump 32 such that the introduction pressure of the airflow is in the range of 0.01 MPa or more and 1.00 MPa or less. As described above, when the introduction pressure of the airflow is too low, the droplet formation distance tends to be lengthened, and when the introduction pressure of the airflow is too high, the droplets 4*b* tend to diffuse, but it is possible to prevent the droplets 4*b* from diffusing while preventing the droplet formation distance from being lengthened by setting the introduction pressure of the airflow to the above range.

In addition, the control unit 5 can drive the pressure pump 32 such that the introduction pressure of the airflow is less than 0.15 MPa. As shown in FIG. 2, when the introduction pressure of the airflow is too high, an effect of preventing the diffusion of the droplets 4*b* may be reduced, but by driving the pressure pump 32 such that the introduction pressure of the airflow is less than 0.15 MPa, it is possible to particularly effectively prevent the droplets 4*b* from diffusing.

In addition, for example, the control unit 5 can adjust the introduction pressure of the airflow in accordance with the ejection pressure of the liquid 4 such that the introduction pressure of the airflow increases as the ejection pressure of the liquid 4 increases, or the introduction pressure of the airflow decreases as the ejection pressure of the liquid 4 increases. Therefore, since the liquid ejection device 1 of the present embodiment can adjust the introduction pressure of the airflow to a preferable condition in accordance with the ejection pressure of the liquid 4, it is possible to, in accordance with the ejection pressure of the liquid 4, effectively prevent the droplets 4*b* from diffusing while preventing the droplet formation distance from being lengthened.

Here, FIG. 4 is a graph showing a relationship between the ejection pressure of the liquid 4 and the ratio of the introduction pressure of the airflow to the ejection pressure of the liquid 4 when the droplet formation distance can be minimized under the condition that the droplets 4*b* in a preferable state can be formed. In FIG. 4, "the ratio of the introduction pressure of the airflow to the ejection pressure of the liquid 4" is indicated by "introduction pressure of airflow/ejection pressure of liquid". Based on the graph of FIG. 4, for example, when the ejection pressure of the liquid 4 is 2 MPa or less, the control unit 5 can set the ratio of the introduction pressure of the airflow to the ejection pressure of the liquid 4 to 0.06 or more. For example, when the ejection pressure of the liquid 4 is in a range from 2 MPa to 5 MPa, the ratio of the introduction pressure of the airflow to the ejection pressure of the liquid 4 can be in a range of 0.02 or more to 0.07 or less. In addition, for example, when the ejection pressure of the liquid 4 is in a range from 5 MPa to 10 MPa, the ratio of the introduction pressure of the airflow to the ejection pressure of the liquid 4 can be in a range of 0.01 or more to 0.03 or less. Further, for example, when the ejection pressure of the liquid 4 is 10 MPa or more, the ratio of the introduction pressure of the airflow to the ejection pressure of the liquid 4 can be 0.01 or less.

Figure 5:
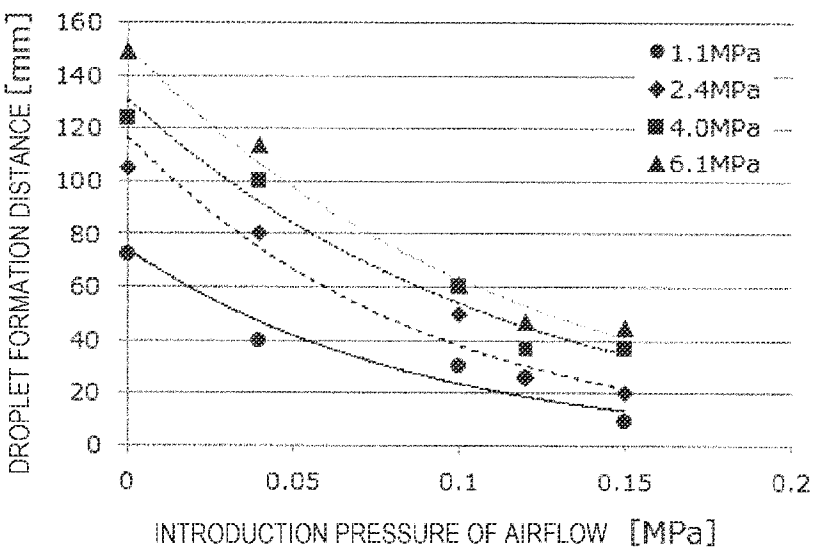
FIG. 5 is a graph showing a relationship between the introduction pressure of the airflow and the droplet formation distance for each ejection pressure of the liquid under the condition that droplets in a preferable state can be formed.

Next, a control method of shortening the droplet formation distance will be described with reference to FIGS. 5 and 6. FIG. 5 shows a change in the droplet formation distance relative to the introduction pressure of the airflow for each introduction pressure of the liquid. As shown in FIG. 5, when the introduction pressure of the airflow is increased, the droplet formation distance tends to be shortened. Therefore, considering only the viewpoint of shortening the droplet formation distance, it is preferable to increase the introduction pressure of the airflow. However, as described above, when the introduction pressure of the airflow is increased, the droplets 4*b* tends to diffuse. In addition, as the introduction pressure of the airflow increases, a degree of shortening the droplet formation distance is reduced when the introduction pressure of the airflow is further increased, and an effect of shortening the droplet formation distance by increasing the introduction pressure of the airflow is reduced.

Figure 6:
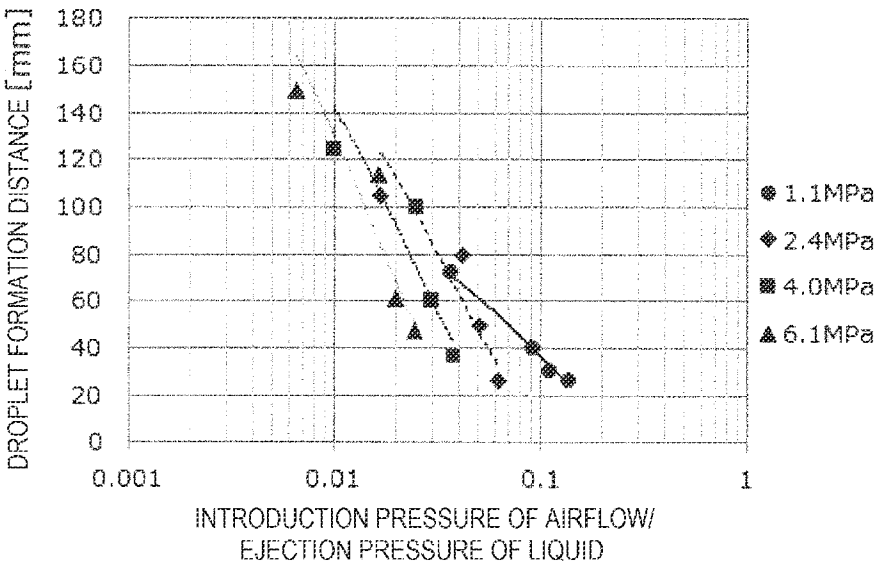
FIG. 6 is a graph showing a relationship between the ratio of the introduction pressure of the airflow to the ejection pressure of the liquid and the droplet formation distance for each ejection pressure of the liquid under the condition that droplets in a preferable state can be formed.

As shown in FIG. 6, when comparing ratios of the introduction pressure of the airflow to the ejection pressure of the liquid 4 having the same droplet formation distance, the larger the ejection pressure of the liquid 4 is, the smaller the ratio is. Here, when the preferable droplet formation distance is 50 mm or less, in order to shorten the droplet formation distance to a preferable distance, the ratio of the introduction pressure of the airflow to the ejection pressure of the liquid 4 is preferably 0.02 or more when the ejection pressure of the liquid 4 is 6.1 MPa. Similarly, when the ejection pressure of the liquid 4 is 4.0 MPa, the ratio of the introduction pressure of the airflow to the ejection pressure of the liquid 4 is preferably 0.03 or more, when the ejection pressure of the liquid 4 is 2.4 MPa, the ratio of the introduction pressure of the airflow to the ejection pressure of the liquid 4 is preferably 0.04 or more, and when the ejection pressure of the liquid 4 is 1.1 MPa, the ratio of the introduction pressure of the airflow to the ejection pressure of the liquid 4 is preferably 0.07 or more.

Figure 7:
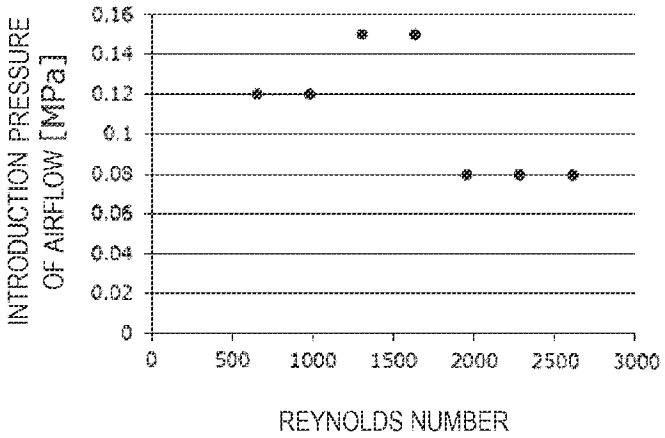
FIG. 7 is a graph showing a relationship between a Reynolds number and the introduction pressure of the airflow when the droplet formation distance can be minimized under the condition that droplets in a preferable state can be formed.

Next, a control method of shortening the droplet formation distance will be described from the viewpoint of a Reynolds number with reference to FIG. 7. FIG. 7 shows a relationship between the Reynolds number of the liquid 4 in the nozzle 23 and the introduction pressure of the airflow when the droplet formation distance can be minimized under a condition that the droplets 4*b* in a preferable state can be formed. As shown in FIG. 7, the introduction pressure of the airflow that can minimize the droplet formation distance in a preferable droplet state varies when the Reynolds number of the liquid 4 in the nozzle 23 is in a range of 1000 or less, when the Reynolds number of the liquid 4 in the nozzle 23 is in a range of exceeding 1000 and less than 2000, and when the Reynolds number of the liquid 4 in the nozzle 23 is 2000 or more.

Therefore, in the liquid ejection device 1 of the present embodiment, the control unit 5 can adjust the introduction pressure of the airflow based on the Reynolds number of the liquid 4 in the nozzle 23. As shown in FIG. 7, if Reynolds numbers of the liquid 4 in the nozzle 23 are different, preferable introduction pressures of the airflow for preventing the droplets 4*b* from diffusing while shortening the droplet formation distance are different. Since the liquid ejection device 1 of the present embodiment can adjust the introduction pressure of the airflow based on the Reynolds number of the liquid 4 in the nozzle 23, it is possible to, in accordance with the Reynolds number of the liquid 4 in the nozzle 23, effectively prevent the droplets 4*b* from diffusing while preventing the droplet formation distance from being lengthened. For example, by storing a table of the relationship between the Reynolds number and the introduction pressure of the airflow in the storage unit 51, the control unit 5 can easily control the driving of the liquid feeding pump 22 and the pressure pump 32 based on the relationship table.

As the Reynolds number approaches 2300 from a low value, the liquid 4 in the nozzle 23 changes from a laminar flow to a turbulent flow. Therefore, it is considered that the introduction pressure of the airflow that can minimize the droplet formation distance in a preferable droplet state varies when the Reynolds number of the liquid 4 in the nozzle 23 is in the range of exceeding 1000 and less than 2000, and when the Reynolds number of the liquid 4 in the nozzle 23 is in the range of 2000 or more. Therefore, the control unit 5 can adjust the introduction pressure of the airflow such that the introduction pressure of the airflow when the Reynolds number is 2000 or more in which the liquid 4 in the nozzle 23 is a turbulent flow is lower than that when the Reynolds number is less than 2000 in which the liquid 4 in the nozzle 23 is a laminar flow.

As described above, depending on whether the liquid 4 in the nozzle 23 is a laminar flow or a turbulent flow, the preferable introduction pressures of the airflow for preventing the droplets 4*b* from diffusing while shortening the droplet formation distance are significantly different. In the liquid ejection device 1 of the present embodiment, by adjusting the introduction pressure of the airflow such that the introduction pressure of the airflow when the liquid 4 in the nozzle 23 has the Reynolds number of a turbulent flow is lower than that when the liquid 4 in the nozzle 23 has the Reynolds number of a laminar flow, it is possible to, in accordance with a state of the liquid 4 in the nozzle 23, particularly effectively prevent the droplets 4*b* from diffusing while preventing the droplet formation distance from being lengthened.

The control unit 5 can change the introduction pressure of the airflow depending on whether the Reynolds number of the liquid 4 in the nozzle 23 is 1000 or less or exceeds 1000. That is, the control unit 5 can adjust the introduction pressure of the airflow based on whether the Reynolds number of the liquid 4 in the nozzle 23 is a threshold value or less or exceeds the threshold value when the liquid 4 in the nozzle 23 that is a laminar flow has the Reynolds number of less than 2000. Therefore, the liquid ejection device 1 of the present embodiment can effectively prevent the droplets from diffusing while preventing the droplet formation distance from being lengthened.

According to FIG. 7, a threshold value when the Reynolds number being 2000 corresponding to whether the liquid 4 in the nozzle 23 is the laminar flow or the turbulent flow can be set a first threshold value, and a threshold value when the Reynolds number being 1000 when the liquid 4 in the nozzle 23 is the laminar flow can be set as a second threshold value. In the liquid ejection device 1 of the present embodiment, the introduction pressure of the airflow can be adjusted based on the first threshold value and the second threshold value. More specifically, in the liquid ejection device 1 of the present embodiment, the introduction pressures of the airflow when the Reynolds number is the second threshold value or less, when the Reynolds number exceeds the second threshold value and is less than the first threshold value, and when the Reynolds number is the first threshold or more can be increased in an order of when the Reynolds number is the first threshold or more, when the Reynolds number is the second threshold value or less, and when the Reynolds number exceeds the second threshold value and is less than the first threshold value.

The present disclosure is not limited to the embodiment described above, and can be implemented in various configurations without departing from the scope of the disclosure. In order to solve some or all of problems described above, or to achieve some or all of effects described above, technical characteristics in the embodiment corresponding to the technical characteristics in each embodiment described in the summary of the disclosure can be replaced or combined as appropriate. The technical features can be deleted as appropriate unless the technical features are described as essential in the present description.

What is claimed is:

1. A liquid ejection device comprising:

a nozzle configured to eject a liquid;

an airflow introduction member configured to introduce an airflow to the liquid;

a liquid feeding pump configured to adjust a pressure of the liquid; and a pressure pump configured to adjust an introduction pressure of the airflow introduced by the airflow introduction member, wherein a ratio of the introduction pressure of the airflow to an ejection pressure of the liquid is 0.005 or more and 0.11 or less.

2. The liquid ejection device according to claim 1, wherein the introduction pressure of the airflow is in a range of 0.01 MPa or more and 0.15 MPa or less.

3. The liquid ejection device according to claim 1, further comprising:

a processor configured to adjust the introduction pressure of the airflow in accordance with the ejection pressure of the liquid.

4. The liquid ejection device according to claim 3, wherein the processor adjusts the introduction pressure of the airflow based on a Reynolds number of the liquid in the nozzle.

5. The liquid ejection device according to claim 4, wherein the processor adjusts the introduction pressure of the airflow such that the introduction pressure of the airflow when the liquid in the nozzle has a Reynolds number of a turbulent flow is lower than that when the liquid in the nozzle has a Reynolds number of a laminar flow.

6. The liquid ejection device according to claim 4, wherein the processor adjusts the introduction pressure of the airflow based on whether the Reynolds number of the liquid in the nozzle is a threshold value or less or exceeds the threshold value when the liquid in the nozzle has a Reynolds number of a laminar flow.

* * * * *